US008714144B2

(12) United States Patent
Zadra

(10) Patent No.: US 8,714,144 B2
(45) Date of Patent: May 6, 2014

(54) INTERCHANGEABLE GUN BARREL APPARATUS AND METHODS

(76) Inventor: Lawrence J. Zadra, Laguna Hills, CA (US)

( * ) Notice: Subject to any disclaimer, the term of this patent is extended or adjusted under 35 U.S.C. 154(b) by 297 days.

(21) Appl. No.: 12/522,711

(22) PCT Filed: Jan. 9, 2008

(86) PCT No.: PCT/US2008/050686

§ 371 (c)(1),
(2), (4) Date: Jul. 9, 2009

(87) PCT Pub. No.: WO2008/086455

PCT Pub. Date: Jul. 17, 2008

(65) Prior Publication Data

US 2010/0059032 A1 Mar. 11, 2010

Related U.S. Application Data

(60) Provisional application No. 60/879,422, filed on Jan. 9, 2007.

(51) Int. Cl.
*F41B 11/62* (2013.01)
*F41B 11/60* (2013.01)

(52) U.S. Cl.
CPC ..... *F41B 11/62* (2013.01); *F41B 11/60* (2013.01)
USPC ..... 124/74

(58) Field of Classification Search
CPC ..... F41B 11/62; F41B 11/60
USPC ..... 42/75.02, 40, 43, 44, 45; 124/73, 74
See application file for complete search history.

(56) References Cited

U.S. PATENT DOCUMENTS 1,393,057 A * 10/1921 Vollmer ..... 89/16
3,077,045 A * 2/1963 Smith ..... 42/41

(Continued)

FOREIGN PATENT DOCUMENTS

DE 41 07 675 A1 9/1992

OTHER PUBLICATIONS

David E. Petzal, Four Rifles in One, Field & Stream Magazine, Oct. 2006, vol. CXI, No. 6,; Cover Page, p. 32 & 34 (3 pgs.).

(Continued)

*Primary Examiner* — Stephen M Johnson

(57) ABSTRACT

A system and related methods for interchanging barrels on a gun and packaging such components is described herein. Preferably, the system includes a barrel having a first end, a second end, and a shaft between the first end and the second end. In one embodiment, the barrel includes a clamping screw notch and a barrel indexing surface formed on the shaft. The system further includes a breech block having a barrel housing formed therein having a first end, a second end, and a hollow core therebetween for receiving the barrel, and an indexing pin positioned to engage the barrel indexing surface upon receipt of the barrel through the barrel housing. The first end of the barrel housing is adapted to engage the receiver of the gun. The second end of the barrel housing includes a clamp and a clamping screw orifice formed therein for receiving a clamping screw. Preferably a portion of the clamping screw extends partially into the barrel housing to engage the clamping screw notch upon receipt of the barrel through the barrel housing, although alternatives such as a set screw are also disclosed. Tightening of (1) the clamping screw within the clamping screw orifice or (2) the set screw removably joins the barrel to the barrel housing.

10 Claims, 16 Drawing Sheets

(56) References Cited

U.S. PATENT DOCUMENTS

| | | | | | |
|---|---|---|---|---|---|
| 3,177,603 | A | | 4/1965 | Gillespie | |
| 3,198,076 | A | | 8/1965 | Stoner | |
| 3,738,044 | A | | 6/1973 | Robinson | |
| 4,774,929 | A | * | 10/1988 | Milliman | 124/76 |
| 4,779,370 | A | | 10/1988 | Cormack | |
| 4,883,042 | A | | 11/1989 | Wackrow | |
| 5,078,118 | A | | 1/1992 | Perrone | |
| 5,400,536 | A | * | 3/1995 | Milliman | 42/65 |
| 5,404,863 | A | | 4/1995 | Poor | |
| 5,540,008 | A | * | 7/1996 | Kirnstatter | 42/75.02 |
| 5,706,599 | A | | 1/1998 | Knight | |
| 5,987,797 | A | | 11/1999 | Dustin | |

OTHER PUBLICATIONS httpen.wikipedia.org_wiki_Webley_and_Scott. (5 pgs.).

httpweb.archive.org_web_20061120101331_http www.webley.com (1 pg.).

Dennis E. Hiller, The Collectors' Guide to Air Rifles, 1985, Front page, Publisher page, pp. 230, 231, 232 and 233, (6 pgs.).

15 Photographs of a Mendoza Air Rifle which indicate patent pending on Rifle.

httpwww.beemans.net_collection.htm.pdf (16 pgs.).

Robert D. Beeman et al.,Blue Book of Airguns, 7th Edition, Mar. 2008?, Blue Book Publisher, 7 pgs.

* cited by examiner

INTERCHANGEABLE GUN BARREL APPARATUS AND METHODS

This application claims priority to U.S. provisional patent application Ser. No. 60/879,422, entitled INTERCHANGEABLE BARREL SYSTEM AND RELATED METHOD FOR USE IN GUNS filed Jan. 9, 2007, and PCT Application No. PCT/US2008/050686, filed Jan. 9, 2008.

FIELD OF THE INVENTION

The present invention relates generally to guns, and more particularly, to a system and methods that provide for interchangeable barrels for use in firing, among other things, multiple caliber projectiles in activities such as shooting an air rifle or firearm, as well as for improved storage, transportation, and handling of same.

BACKGROUND OF THE INVENTION

Guns, whether firearms used primarily to fire cartridges, air rifles used primarily to fire pellets or BBs, or other designs, sometimes include a detachable barrel and interchangeability with other barrels for the firing of multiple caliber projectiles. However, as aptly indicated in U.S. Pat. No. 5,987,797, issued Nov. 23, 1999 to Dustin, "Existing firearm designs which . . . accept a variety of different barrels suffer from a number of deficiencies and impracticalities which render them generally undesirable to consumers and users." That patent notes deficiencies such as: (1) marring of the barrel caused by engagement of a hardened metal set screw upon the relatively softer metal of the barrel to prevent barrel rotation, (2) unreliable accuracy due to non-coaxial alignment of the barrel and action caused by lateral deflection of the barrel when subjected to side engagement of the set screw on the barrel, and stresses generated upon firing that cause an inner barrel to vibrate at its own resonant frequency and to be displaced in an unpredictable manner within an outer barrel, and (3) difficulty in disassembling the barrel and action due to the high degree of torque required to threadedly lock together the barrel and action. See U.S. Pat. No. 5,987,797, at col. 1 1. 13 through col. 2, 1. 18.

In addition, for airguns or similar devices that use a "break barrel" design to cock the gun and prepare it to be fired (rather than using gunpowder, for example), the barrel typically is an integral part of the cocking/arming mechanism. A user typically grips the gun's barrel and stock in opposite hands and "cocks" or arms the gun by folding it (using the barrel and stock for leverage). The user then unfolds the gun into its normal linear configuration prior to aiming and firing it. Depending on the gun, this folding/pump action can set an internal spring that, when released by the user squeezing the gun's trigger, provides the air pressure to propel the pellet or other projectile out of the gun. Accordingly, it is counterintuitive to remove the barrel from such a break barrel gun, because without the barrel assembled with the rest of the gun, the user does not have sufficient leverage to "arm" the gun.

Accordingly, it is desirable to provide a system and related methods that overcome the above-referenced deficiencies, as well as to provide related benefits in manufacturing, shipping, storage, retail display and handling, etc. Such a system can provide an interchangeable barrel system for use in firing, among other things, multiple caliber projectiles in activities such as shooting an air rifle or firearm, in a relatively more efficient and reliable manner when compared to known guns having interchangeable barrel systems. Such an improved system can provide related safety and economic benefits to final users of the guns.

SUMMARY OF THE INVENTION

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The present invention relates generally to guns, and more particularly, the present invention relates to a system and methods that provide for interchangeable barrels for use in firing, among other things, multiple caliber projectiles in activities such as shooting an air rifle or firearm.

In one embodiment, the system for interchanging barrels on a gun includes a barrel for firing projectiles. The barrel includes a receiver end, a muzzle end, and a shaft therebetween connecting the receiver end and the muzzle end. Preferably, the barrel further includes a clamping screw notch and a barrel indexing surface formed on the shaft.

The system further includes a breech block having a barrel housing formed therein. The barrel housing includes a first end, a second end, and a hollow core therebetween for receiving the barrel, and an indexing pin positioned to engage the barrel indexing surface upon receipt of the barrel through the barrel housing.

The first end of the barrel housing is adapted to engage the receiver of the gun. The second end of the barrel housing includes a clamp and a clamping screw orifice formed therein for receiving a clamping screw. Preferably, when received into the clamping screw's orifice, a portion of the clamping screw extends partially into the barrel housing to engage the clamping screw notch upon receipt of the barrel through the barrel housing. Tightening of the clamping screw within the clamping screw orifice removably joins the barrel to the barrel housing. Among the many alternative embodiments of the invention, a set screw can be provided to engage a corresponding/keyed indentation on the barrel, to facilitate the desired interchangeability of the barrels and related benefits in storage, safety, economy, etc.

These and other embodiments will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 13 is a bottom view of an end of the breech with a set screw inserted into a hole, with a corresponding allen wrench laying alongside;

FIG. 14 is a bottom view showing the breech of FIG. 13 removed from the stock, alongside a mating barrel 110 having a seat or screw notch 111, with the set screw 101 removed from the set screw hole 103 in the breech;

FIG. 15 is similar to FIG. 14, but shows the barrel 110 partially inserted into the breech;

FIG. 16 is similar to FIG. 15, but shows the barrel 110 further inserted into the breech;

FIG. 17 is similar to FIGS. 15 and 16, but shows the barrel 110 fully inserted into the breech so that the seat or screw notch 111 is generally aligned with the set screw hole 103 in the breech, to permit subsequent insertion of the set screw 101;

FIG. 18 is a side elevation view of the assembly of FIG. 17, showing alignment markings such as arrows 107 and 109 that can make it easier for a user to properly align the parts prior to inserting screw 101;

FIG. 19 shows insertion of the screw 101 using an allen wrench 105; and FIG. 20 shows the fully assembled gun, with the screw 101 inserted into a position to hold the parts in desired relationship with each other.

DETAILED DESCRIPTION

Figure 1:
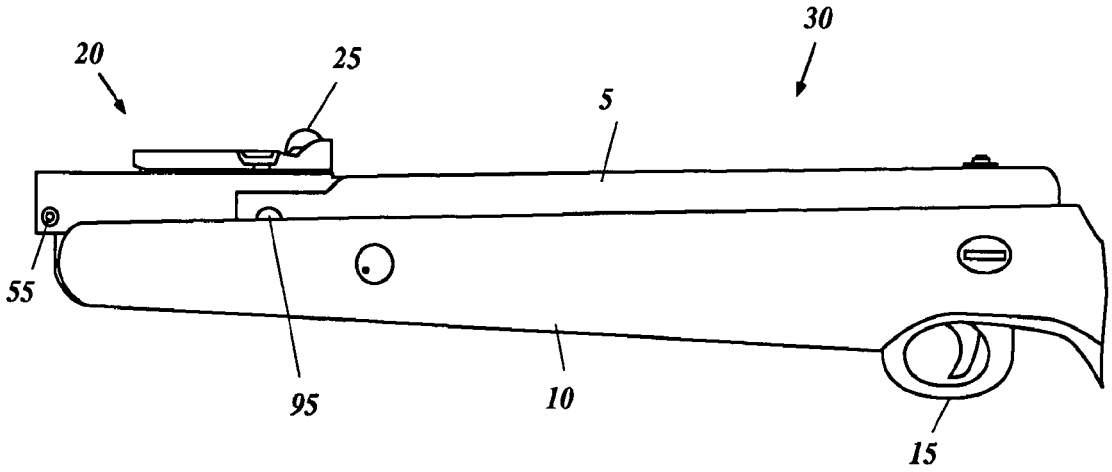
FIG. 1 shows a receiver, stock, trigger mechanism, and breech block including a rear sight of a typical single shot break barrel air rifle.

Embodiments of the present invention will now be described with references to the accompanying Figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention herein described.

The system and related methods of the present invention is described herein as it relates to a single-shot break barrel air rifle. Generally, the typical single shot break barrel air rifle permits the barrel and receiver to separate and rotate about a pivot pin to an open position, to allow insertion of a projectile into the barrel positioned within the breech block, and further permits actuation of a cocking or pump mechanism. Once loaded with a projectile (pellet or BB) and actuated, the breech block and receiver are brought back together so that the breech block and receiver are in a closed position, and the weapon is ready for firing.

Preferably, the air pressure used to propel projectiles in certain embodiments of the invention include generation mechanisms and air pressure tubes that are similar or even identical to conventional and well-known similar elements (generation mechanisms and air pressure tubes) in the art. Persons of ordinary skill in the art will understand that these structures can be provided in any suitable form while still accomplishing the objectives of the invention.

Persons of ordinary skill in the art will recognize that the present invention may be adapted for use in air pistols, as well as for other firearms including rifles and pistols. Furthermore, persons of ordinary skill in the art will understand that the principles of the present invention, as described herein, are readily adaptable to air guns or firearms capable of a single shot or multiple shot capacities. In this regard, for example, and as explained below, in one manufacture's related air rifle series, the barrel assembly of the present invention may be interchanged with a solid barrel assembly (non-removable) to convert the non-removable barrel system to a removal barrel system that permits different barrels to be interchanged for use in firing multiple caliber projectiles.

Material construction, that is, the use of various metals, plastics, composites, woods, etc. in the manufacture of the barrel, breech block, receiver, stock, etc., is well known in the art. Typically, the use of such materials in the construction of the present invention is based on a number of factors, including (among others) cost, weight, and intended function of the material, and the material's aesthetic appeal, i.e., appearance.

Figure 2:
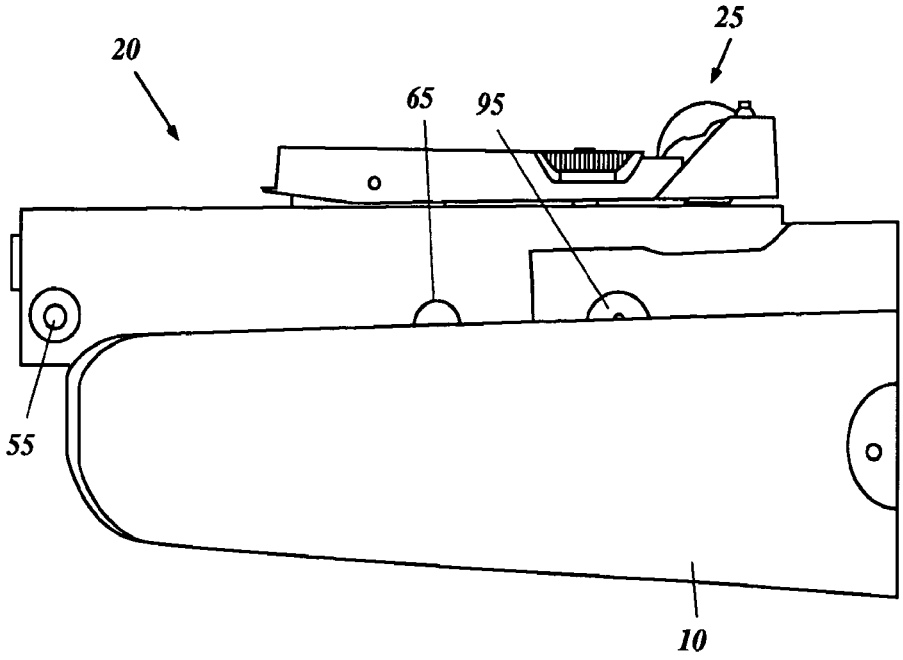
FIG. 2 is an enlarged view of the breech block including the rear sight of the air rifle shown in FIG. 1.

FIG. 1 and FIG. 2 (an enlarged view of the breech block of FIG. 1), show a receiver 5 (also known as, or to perform as or to constitute, an air pressure tube), stock 10, trigger mechanism 15, and breech block 20 including a rear sight 25 of a typical single shot break barrel air rifle 30 used with the present invention. In this regard, with the exception of minor modifications to the breech block 20 (to allow the interchangeability of barrels), the above-noted parts are substantially the same parts used in one manufacturer's solid barrel assembly.

Figure 3:
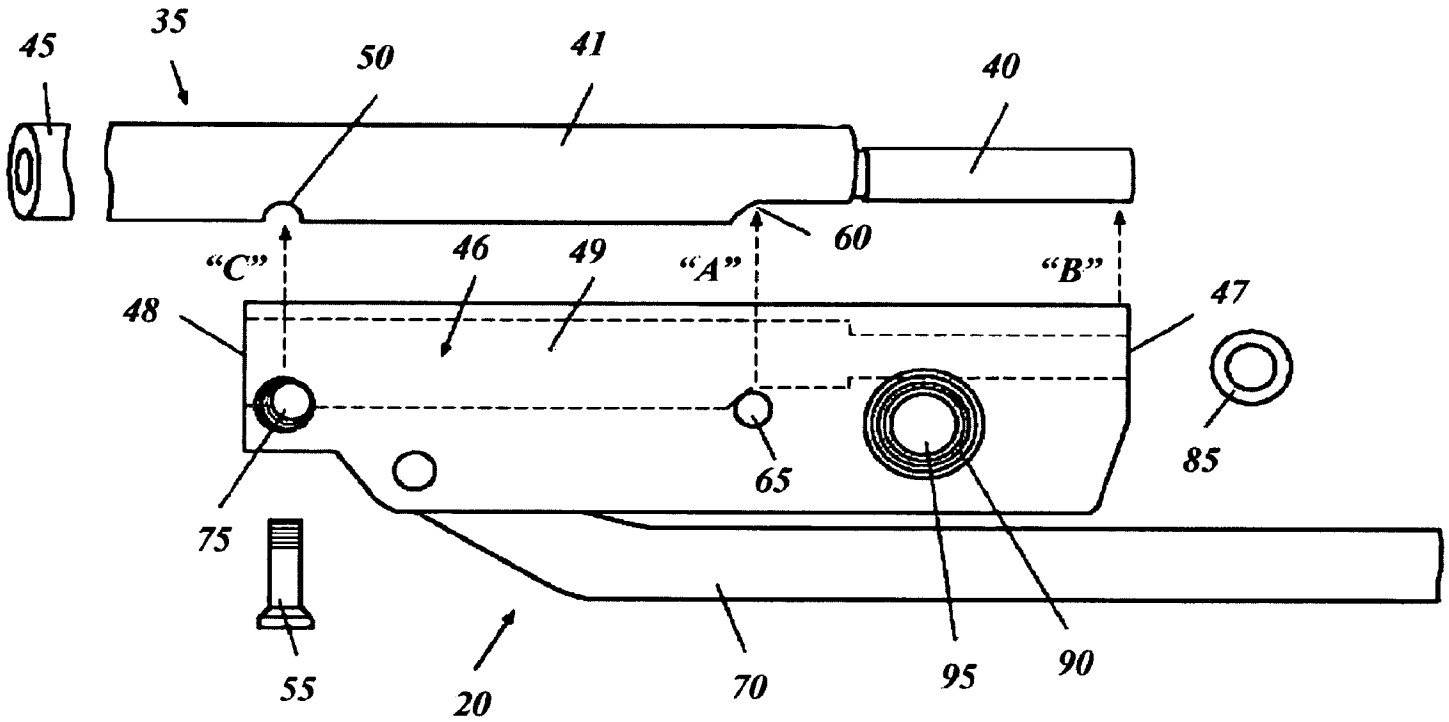
FIG. 3 shows the apparatus of the present invention including a barrel, breech block, clamping screw, and "O" ring that provides for interchangeable barrels for use in firing, among other things, multiple caliber projectiles (pellets or BBs) in activities such as shooting an air rifle.

FIG. 3 shows the apparatus of the present invention that provides for interchangeable barrels for use in firing, among other things, multiple caliber projectiles (pellets or BBs) in activities such as shooting an air rifle. In this regard, the present invention preferably includes a barrel 35 having a first end or receiver end 40 for receiving projectiles to be fired, a second end or muzzle end 45 for discharging the projectile from the rifle, and a shaft 41 therebetween connecting the first end 40 and second end 45. In this regard, the receiver end 40 of the barrel 35 may receive or have projectiles loaded directly into it, as would be the case with a break barrel type rifle, or be loaded indirectly, as would be the case with a projectile loaded initially into the rifle's receiver 5, and then fed into the barrel 35.

The inside diameter of the barrel 35 corresponds to the pellet or BB diameter (caliber) that the user intends to fire from the rifle 30. Accordingly, when a different size pellet or BB is to be fired from the rifle 30, the barrel 35 must be interchanged with another barrel that has the appropriate size inside diameter to accept the projectile.

The barrel 35 preferably further includes a clamping screw notch 50 for engaging a clamping screw 55, and a barrel indexing surface 60 for engaging an indexing pin 65 that is preferably press fitted into the breech block 20. Preferably, the clamping screw notch 50 and barrel indexing surface 60 are formed on the shaft 41 of the barrel 35 by the removal of barrel material from the outside surface of the barrel 35.

The breech block 20 further includes a barrel housing or chamber 46 formed within the breech block 20. The barrel housing 46 includes a first end 47, a second end 48, and a hollow core 49 connecting the first end 47 and the second end 48 for receiving the barrel 35 therethrough. In this embodiment, the breech block 20 further includes an attached force actuating means such as a cocking mechanism 70 for activating an air piston (not shown). Persons of ordinary skill in the art will understand that other force actuating means may be employed while still enjoying the benefits of the present invention.

The breech block 20 preferably further includes a clamping screw orifice 75 for threadedly receiving the clamping screw 55, an "O" ring landing 80 (shown in FIGS. 9, 10, and 11) for receiving an "O" ring 85, and a pivot pin housing 90 for threadedly receiving a pivot pin 95 (FIG. 1). In this regard, the invention permits a non-removable barrel system to be converted to a removable barrel system that permits different barrels to be interchanged for use in firing multiple caliber projectiles. Among the many ways of accomplishing this, the pivot pin 95 of the non-removable barrel system's breech block can be removed from its engagement with the receiver 5, the non-removable barrel system's breech block then can be removed and replaced with a removable barrel system's breech block 20, and the pivot pin 95 can be re-threaded into the pivot pin housing 90 to engage the breech block 20 with the receiver 5.

Figure 4:
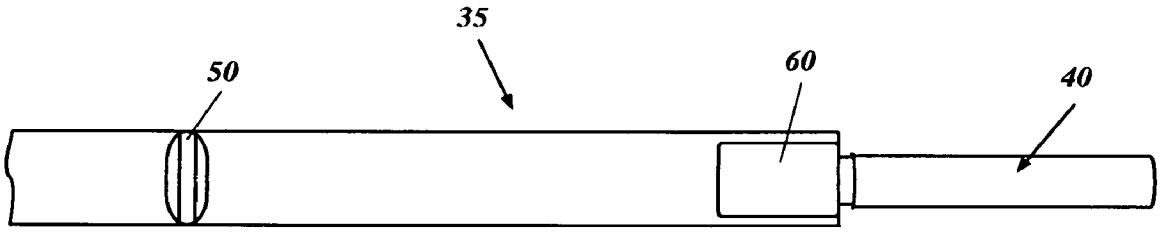
FIG. 4 shows a partial view of a barrel including a first end of the barrel, a second end of the barrel, a shaft between the first end and second end, a clamping screw notch, and a barrel indexing surface.
Figure 5:
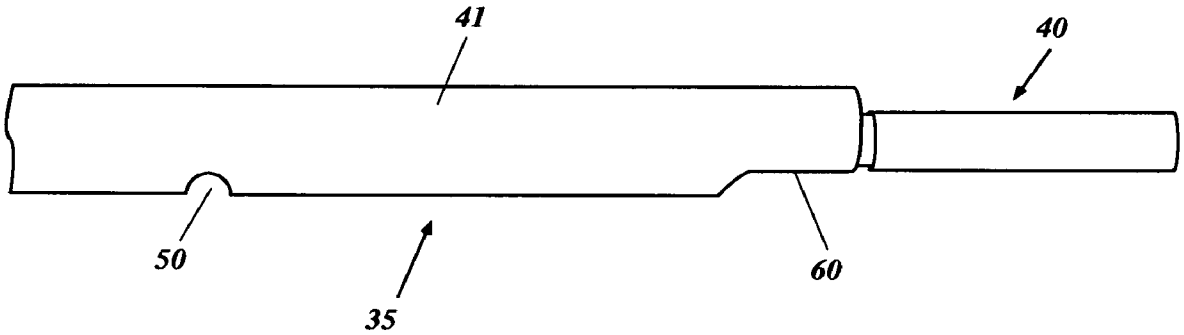
FIG. 5 shows another view of the barrel of FIG. 4, including the clamping screw notch and the barrel indexing surface.
Figure 6:
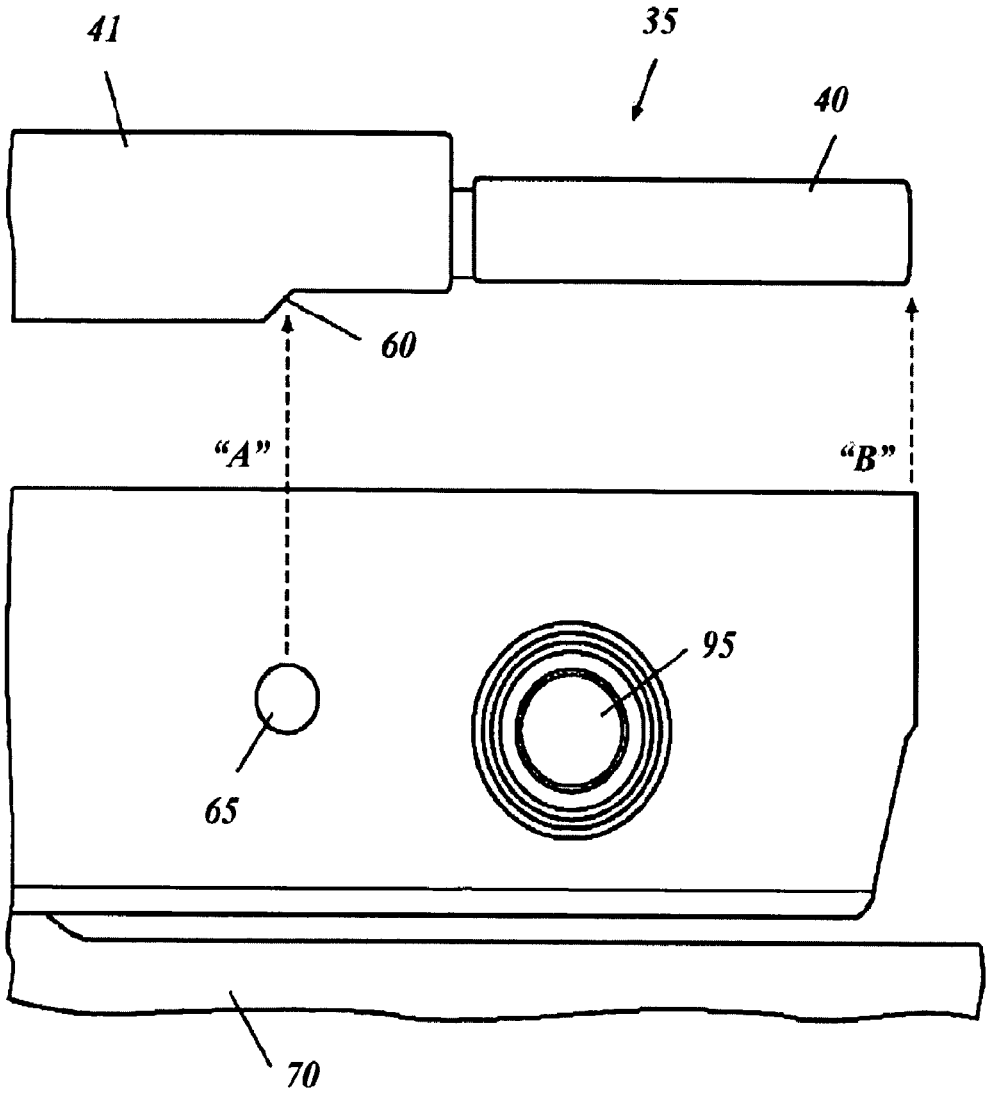
FIG. 6 shows the barrel and a breech block of the present invention having a barrel housing with a first end, a second end, and a hollow core therebetween for receiving the barrel therethrough, and representative alignment and positioning of the barrel after being received into the barrel housing of the breech block.

Preferably after the breech block 20 and receiver 5 of the rifle are engaged and secured in a closed position, the barrel 35 is inserted or received into the breech block 20. As indicated above and shown specifically in FIG. 4 and FIG. 5, in one embodiment, the barrel 35 includes a clamping screw notch 50 and a barrel indexing surface 60. As represented in FIG. 6, as the first end or receiver end 40 of the barrel 35 is received into the breech block 20, the structural relationship or association between the barrel's indexing surface 60 (preferably a substantially flat elongated surface) and the indexing pin's 65 positioning within the breech block 20 ensures proper alignment (engagement of the indexing pin 65 along the barrel indexing surface 60 as shown by reference "A"), positioning of the barrel 35 in the breech block 20 (insertion of the barrel 35 to the proper depth as shown by reference "B", see also FIG. 10), and alignment of the clamping screw notch 50 with the clamping screw orifice 75 (reference "C" of FIG. 3). Persons of ordinary skill in the art will understand that a wide variety of approaches can be used to accomplish this desired indexing and alignment without departing from the scope of the invention.

In other words, in one embodiment, when the barrel 35 is properly positioned and aligned within the barrel housing 46, the indexing pin 65 engages the barrel indexing surface 60, and the clamping screw notch 50 is aligned with the clamping screw orifice 75 so that when received into the clamping screw orifice 75, a portion of the clamping screw 55 engages the clamping screw notch 50. In this regard, the barrel indexing surface 60 and indexing pin 65 prevent rotation of the barrel 35 within the barrel housing 46 and displacement of the barrel 35 toward the receiver 5, the clamping screw notch 50 and clamping screw 55 combination prevents rotation of the barrel 35 within the barrel housing 46 and displacement of the barrel 35 toward and away from the receiver 5, while tightening of the clamping screw 55 further secures the barrel 35 within the barrel housing 46.

Figure 7:
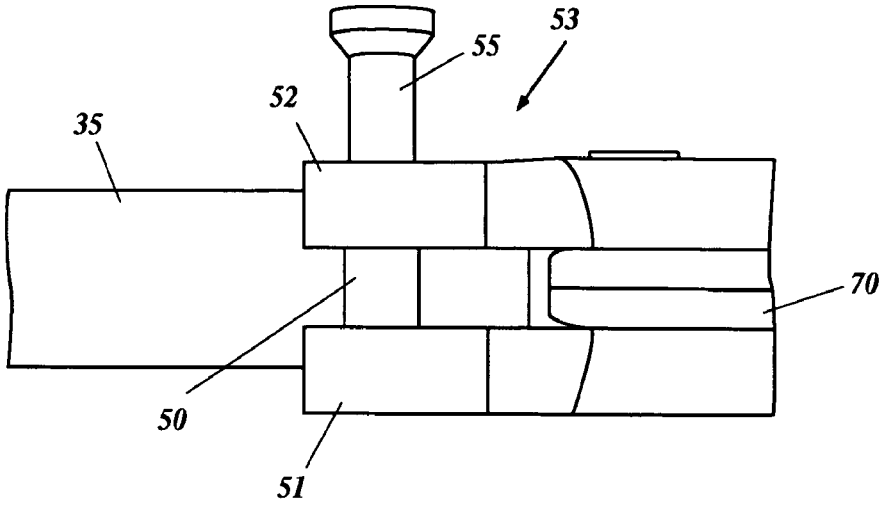
FIG. 7 shows a bottom view of the barrel received into the breech block, alignment of the clamping screw notch and a clamping screw orifice, and the clamping screw positioned to be threadedly received into the clamping screw orifice.

FIG. 7 shows a bottom view of the barrel 35 received into the breech block 20, alignment of the clamping screw notch 50 and the clamping screw orifice 75, and the clamping screw 55 positioned to be threadedly received into the clamping screw orifice 75.

Figure 8:
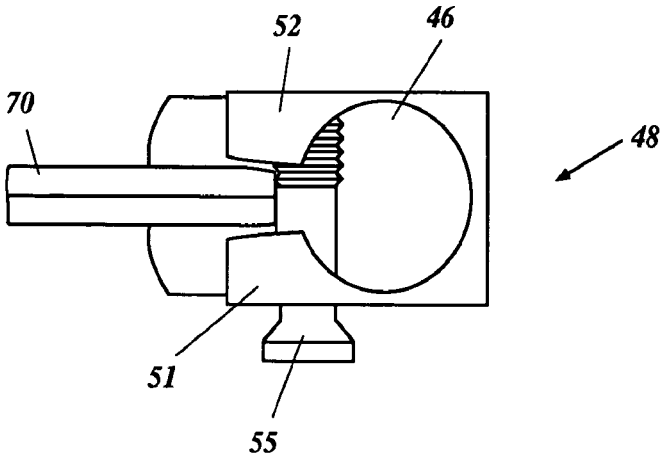
FIG. 8 shows the clamping screw partially received into the clamping screw orifice and its extension into the barrel housing near the first end of the barrel housing.

FIG. 8 shows the clamping screw 55 partially received into the clamping screw orifice 75. In this regard, a portion of the clamping screw 55 extends into the barrel housing 46 near the second end 48 of the barrel housing or chamber 46 so as to engage with the clamping screw notch 50 when the barrel 35 is properly received into the barrel housing 46 of the breech block 20. Once engaged with the clamping screw notch 50 and prior to tightening, the clamping screw prevents displacement of the barrel 35 toward and away from the receiver 5, and rotation of the barrel 35 within the barrel housing 46. The latter function is similar to that achieved by the combination of the barrel indexing surface 60 and indexing pin 65, described above.

As further shown in FIG. 8, the second end 48 of the barrel housing 46 preferably is slit to separate the second end 48 into a first section 51 and a second section 52. In this regard, once the receiver end 40 of the barrel 35 is received into the barrel housing 46, the first section 51 and second section 52 substantially encircle the barrel 35 in a clamp-like fashion. Accordingly, in one embodiment, the second end 48 of the barrel housing 46 of breech block 20, including the two sections 51, 52 formed therein, may be considered a clamp 53 that is brought together by the clamping screw 55 to removably clamp, hold, engage, or otherwise secure the barrel 35 into position in the barrel housing 46. In contrast to other interchangeable barrel systems that utilize a set screw to secure the barrel to the receiver, the containment of the barrel 35 in the barrel housing 46 by the clamping method described herein provides: (1) a relatively greater distribution of force to the barrel without the deficiency of marring the barrel, (2) increases firing accuracy due to a relatively more even distribution of force about the barrel such that coaxial alignment of the barrel and receiver are maintained, and (3) prevents displacement or movement of the barrel toward or away from the receiver when the rifle is fired. In this regard, unlike conventional firearms, spring piston air rifles have "recoil" in two directions. This recoil is produced during firing by the forward motion of the piston and by decompression of the springs that generate the power to move the piston.

As indicated above, in one embodiment, the present invention includes a barrel indexing surface 60 and indexing pin 65 to provide assistance in barrel alignment and positioning when inserting the barrel 35 into the barrel housing 46, as well as to prevent the barrel 35 from rotating within the barrel housing 46. The embodiment preferably further includes a clamping screw notch 50, clamping screw 55, and barrel housing 46 or breech block 20 that is slit to secure the barrel in the barrel housing 46 and to further prevent rotation and lateral (forward) displacement of the barrel 35 within the barrel housing 46.

In an alternative embodiment, the barrel indexing surface 60 and associated indexing pin 65 may be eliminated. In this regard, rotation of the barrel 35 would still be prevented by the clamping screw notch 50 and clamping screw 55 combination, while proper insertion depth of the barrel 35 into the breech block 20 and alignment of the clamping screw notch 50 with the clamping screw orifice 75, may be achieved by manual rotation of the barrel 35 and visual confirmation of the required alignment. However, such manual insertion of the barrel to align and position the barrel may be somewhat more difficult than insertion of the barrel 35 with the aid of the barrel indexing surface 60 in combination with the indexing pin 65.

In still another embodiment, the clamp 53 formed in the barrel housing 46 or breech block 20, as well as the barrel indexing surface 60 and associated indexing pin 65, may be removed. In this embodiment, the breech block 20 would be threaded to receive the clamping screw 55, but the second end 48 of the barrel housing 46 would not be slit to form a first section 51 and second section 52. In this regard, rotation and lateral displacement of the barrel 35 would still be prevented by the combination of the clamping screw notch 50 and the clamping screw 55 without requiring the first section 50 and second section 51 of the barrel housing 46 to be drawn together to secure the barrel in place.

In yet another embodiment, the breech block 20 may be modified so that the clamping screw orifice 75 is positioned so that the screw 55 passes below the barrel 35 and does not engage in any "notch" on the barrel. In this regard, the clamping screw notch 50 could be removed or omitted (or not), and the clamping screw 55 still can threadedly engage with the clamping screw orifice 75. In this embodiment, tightening of the clamping screw 55 would bring together the first section 50 and the second section 51 of the barrel housing 46 or breech block 20 to secure the barrel 35 in place via a frictional grip/clamp force.

Although the drawings illustrate the clamping screw orifice 75 on the lower side of the gun and aligned generally perpendicularly to a longitudinal axis of the barrel 35, the orifice 75 can be positioned on any side of the breech block 20 (and in alignments other than perpendicular to the barrel axis) and still provide the desired engagement of the barrel 35 in the barrel housing 46.

In still yet another embodiment, and as illustrated in FIGS. 13-20, a set screw 101 or similar structure can be used to removably engage a selected barrel to the remainder of the gun assembly (rather than "clamping" the barrel between two parts of the breech 20). For example, the breech 20 can be provided with a screw hole or orifice 103 that is sized and positioned to threadedly receive a set screw 101 and direct it so that tightening the screw will retain the desired barrel in the desired relationship with the gun assembly. Persons of ordinary skill in the art will understand that this set screw orifice 103 can be located on any side of the barrel and in a wide range of directions and angles, although preferably it is provided so that the longitudinal axis of the set screw 101 is generally perpendicularly intersects a longitudinal center axis of the barrel. In certain embodiments, the dimensions of the screw 101 can be such that, when it is inserted sufficiently into the screw orifice 103 without any barrel inserted, the screw can prevent any barrel from being engaged with the remainder of the gun, thereby providing an additional measure of safety when the gun is in storage or otherwise not in use.

Persons of ordinary skill in the art will understand any suitable set screw 101 or similar engagement device may be used in such embodiments. Means for tightening the set screw 101 in the clamping screw orifice 103 likewise can be any suitable means, including an allen wrench 105, a screwdriver, etc.

Such "set screw" embodiments likewise can include alignment and/or positioning means on the barrel or barrels. These can include threads that matingly engage with the set screw 101, a simple mark or marks on the surfaces of the barrel and/or breech (such as, for example, arrows 107 and 109 in FIG. 20), a combination of those elements, and other approaches. By way of example and as indicated above, such alignment and/or positioning means can provide improved alignment of the barrel 35 in the barrel housing 46 of the breech block 20 and a more secure engagement of the barrel 35 to the barrel housing 46.

Figure 14:
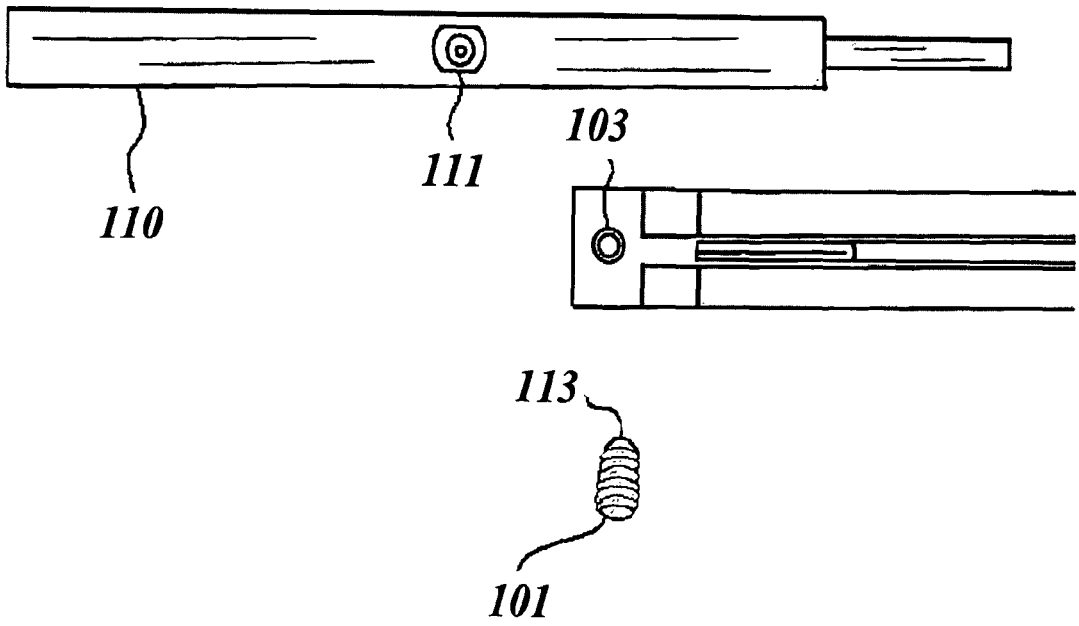
Figure 15:
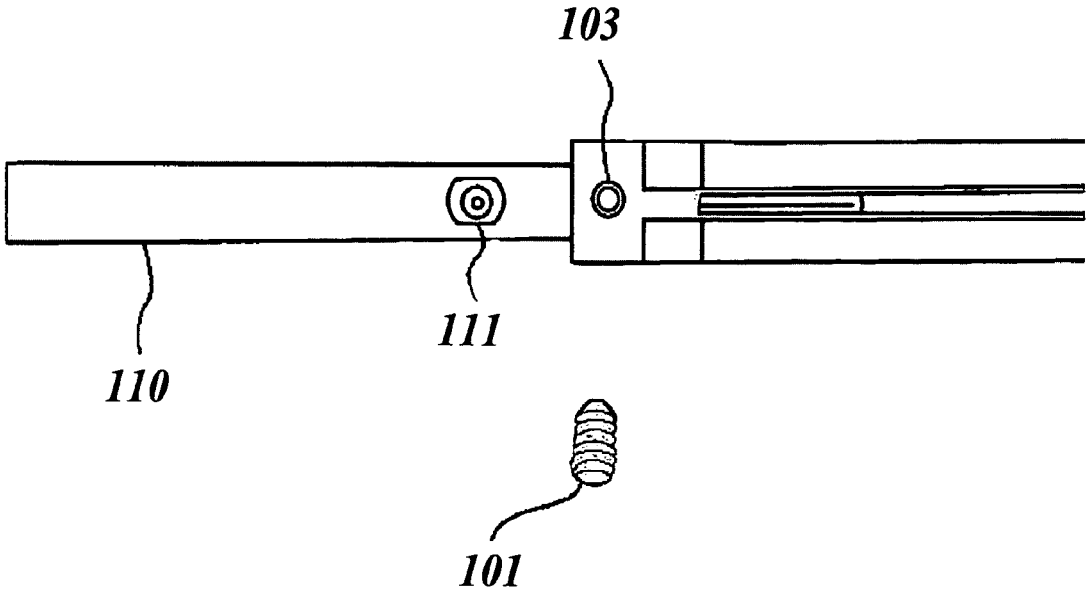
Figure 16:
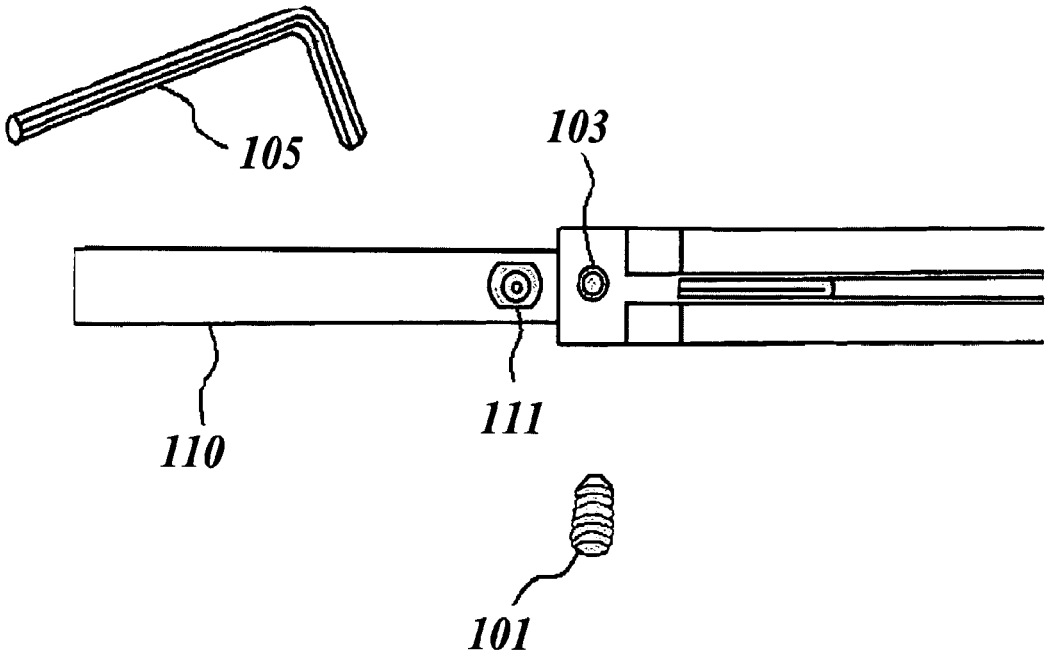
Figure 17:
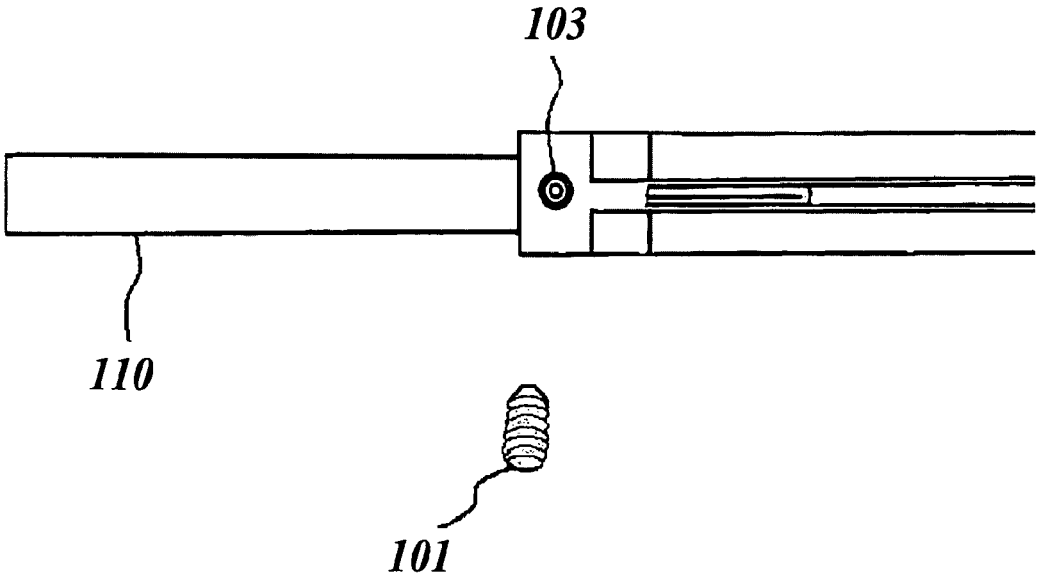
Figure 18:
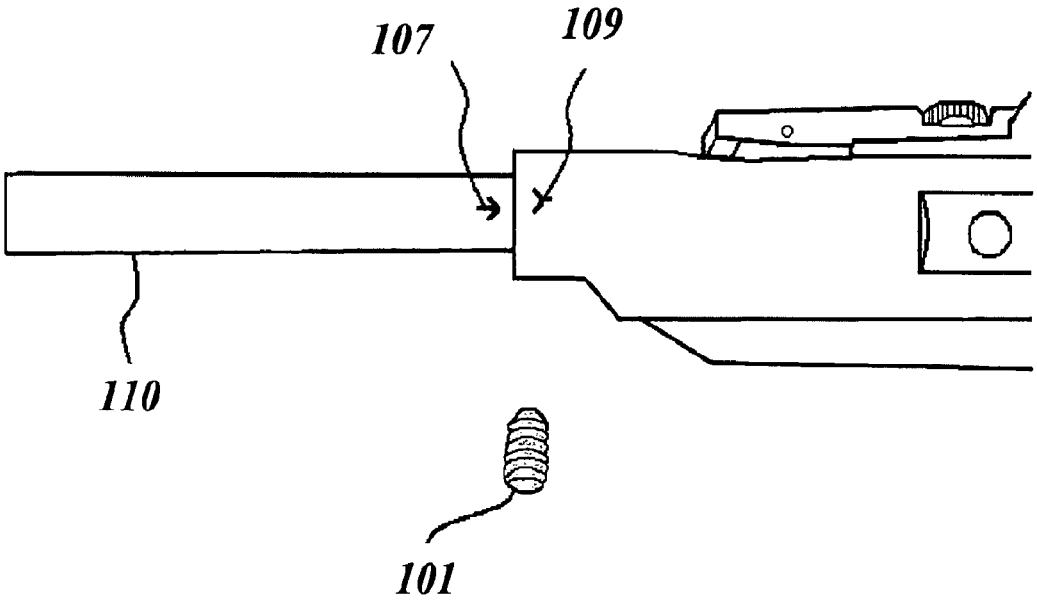
Figure 19:
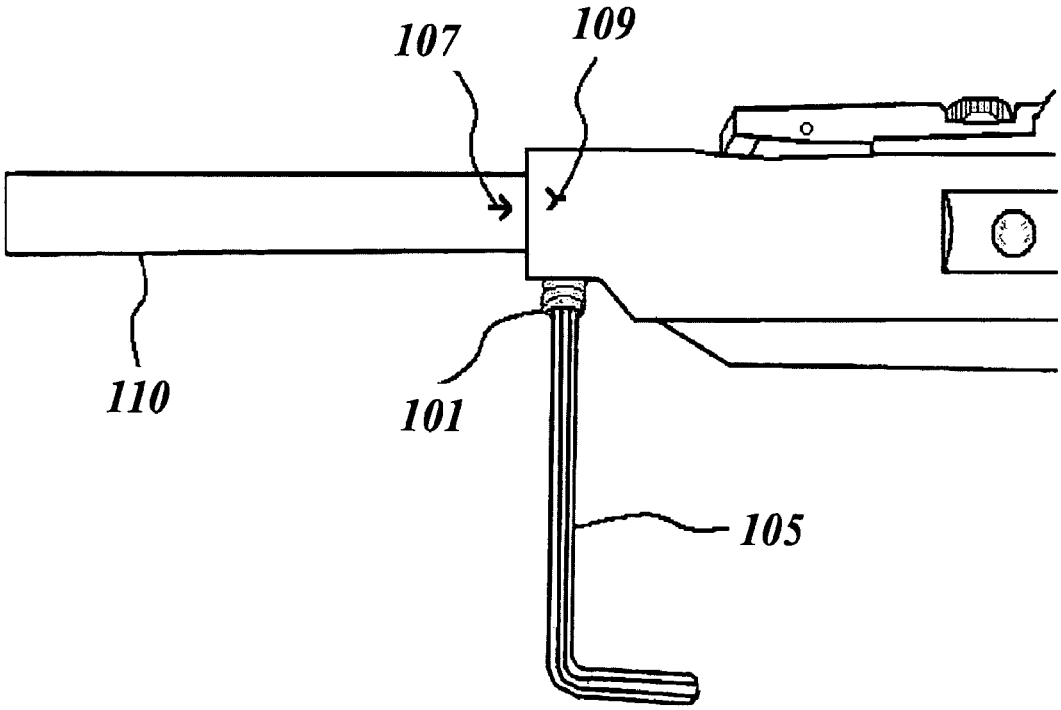
Figure 20:
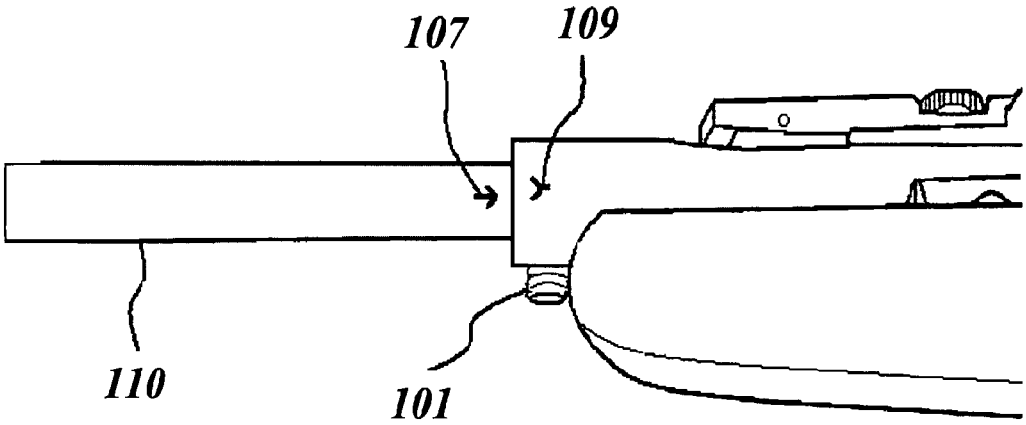

In the embodiment of FIGS. 13-20, the seat/screw notch 111 on the barrel preferably is somewhat domed to generally correspond with the end shape 113 of the set screw 113 (see FIG. 14). This domed shape and/or the markings such as arrows 107 and 109 can make it easier for a user to properly align and assemble the barrel into the breech, and can provide a more precise alignment and better accuracy than if the set screw 101 impinged on the generally flat surface smooth contour of the outside of the barrel. Although none of the domed seat 111 and arrows 107 and 109 are necessary to practice certain embodiments of the invention, they improve the usability and experience of assembling and disassembling the gun. Preferably, there is no marring of the gun barrel because the set screw 101 is seated in the domed shape 111, and in any case the contact area of the set screw on the barrel is concealed within the breech. The domed shape preferably also reduces the torque or other force that might be required to tighten and/or loosen the set screw. In the embodiment of FIGS. 13-20, the screw can be tightened/loosened by hand, using only a small allen wrench 105.

Figure 9:
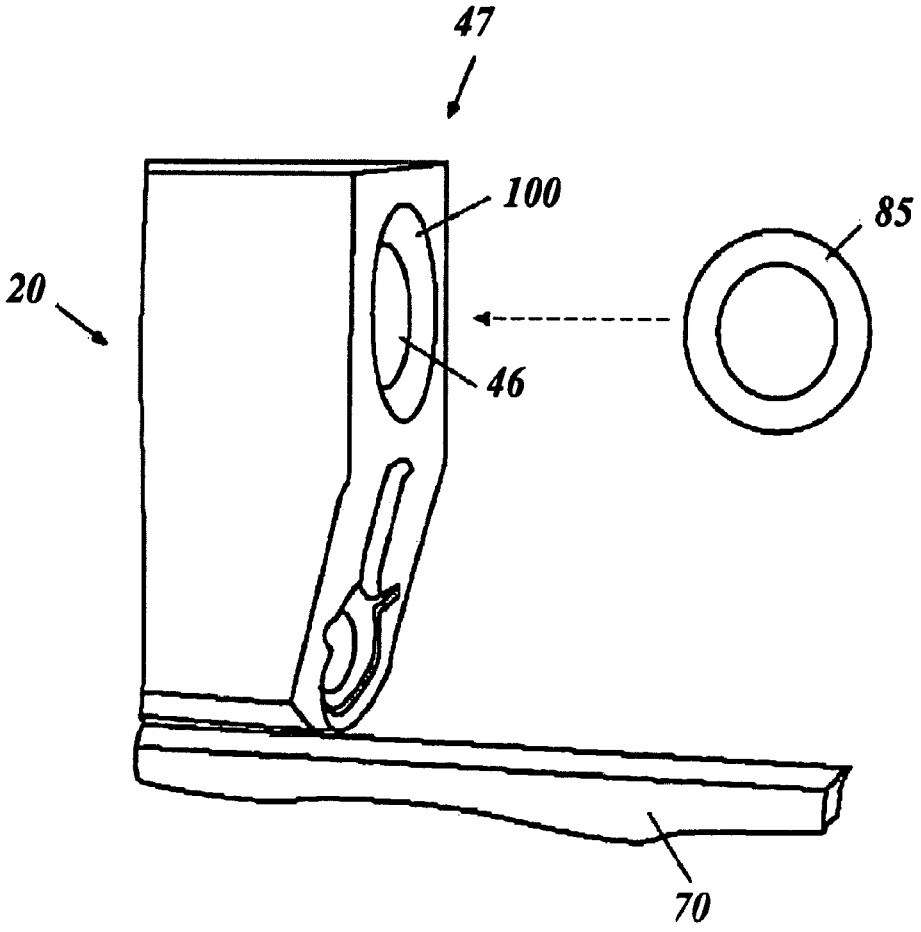
FIG. 9 shows the breech block having an "O" ring landing outer wall formed therein at the second end of the barrel housing.
Figure 10:
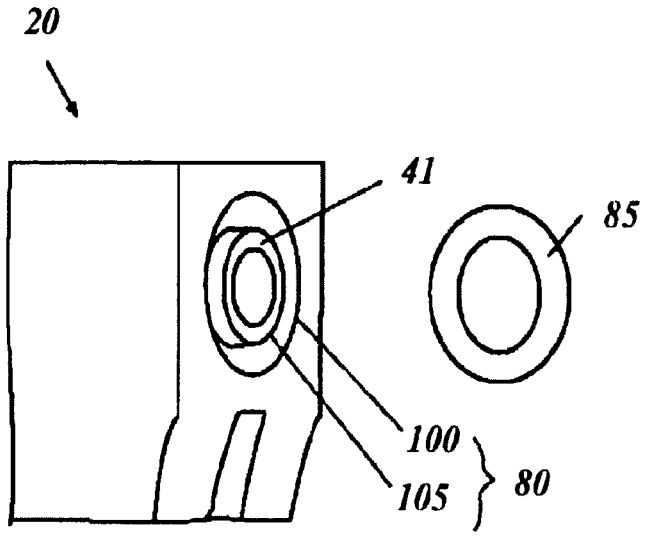
FIG. 10 shows the barrel inserted through the breech block, by way of the barrel housing, to form an "O" ring landing inner wall.
Figure 11:
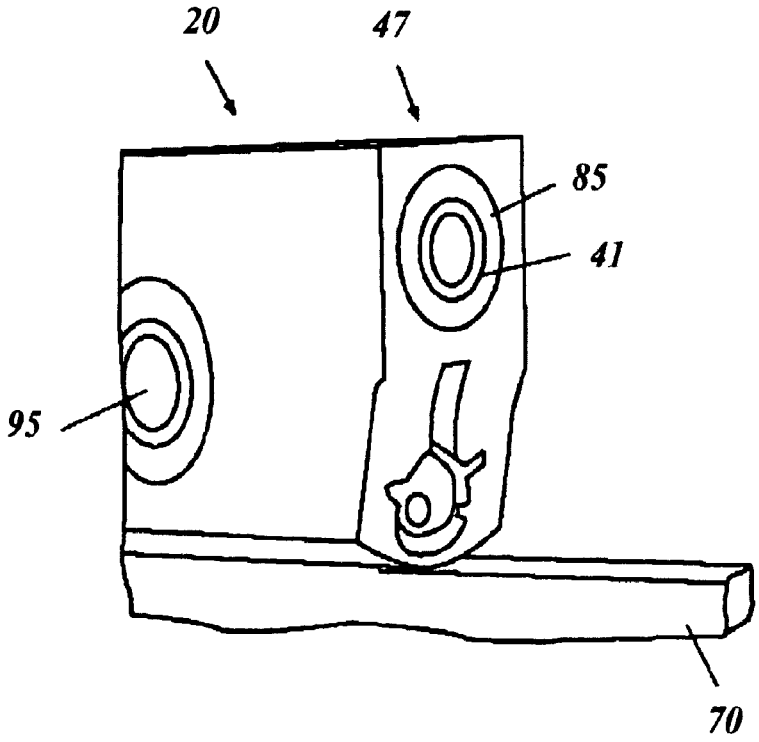
FIG. 11 shows placement of the "O" ring around the first end of the barrel, so as to engage the "O" ring landing outer wall, and "O" ring landing inner wall formed by the first end of the barrel and a first end of the barrel housing formed in the breech block.

FIG. 9 shows the breech block 20 preferably having an "O" ring landing outer wall 100 formed in the first end 47 of the barrel housing 46, while FIG. 10 shows the barrel 35 inserted into the breech block 20 by way of the barrel housing 46 to form an "O" ring landing inner wall 105, and FIG. 11 shows placement of the "O" ring 85 around the first end 40 of the barrel 35 so as to engage the "O" ring landing outer wall 100 and "O" ring landing inner wall 105 formed by the first end 40 of the barrel 35 and the first end 47 of the barrel housing 46 formed in the breech block 20. Such positioning of the "O" ring 85 facilitates a tight seal between the breech block 20 and the associated first end 40 of the barrel 35 and the receiver 5 when the breech block 20 and receiver 5 are in a closed position. Although this O-ring or similar tight seal can provide benefits in the performance of the gun, it is not absolutely required for all embodiments of the invention.

Methods of the invention include, by way of example and not by way of limitation, providing a plurality of interchangeable barrels for a gun of the type described herein, selectively assembling same, disassembling the barrels, and related uses of the gun. The invention includes various methods that can be practiced with or without such a "plurality" of barrels, including improved packaging and storage and safe handling of guns.

For example, a preferred method of assembling a gun includes: providing components as described above, removing the clamping screw 55 from the second end 48 of the barrel housing 46 of the breech block 20; inserting the barrel 35 into the barrel housing 46 of the breech block 20; aligning the clamping screw notch 50 with the clamping screw orifice 75 on the second end 48 of the barrel housing 46 of the breech block 20; and inserting and/or tightening the clamping screw 55 into the clamping screw orifice 75, the clamping screw 55. Other steps of the methods of the invention can include subsequently pulling outward on the barrel 35 to ensure the barrel 35 will not move within the barrel housing 46 of the breech block 20.

For improved safety, methods of the invention include providing a system of the type described above, and inserting the set screw and/or clamping screw when no barrel is inserted into the breech to prevent undesired insertion of a barrel (such as by a child or the like).

Another method of the invention includes packaging a system for interchangeable barrels on a gun, including providing components as described above including at least one removable barrel and a breech 20 without any barrel in it, and packaging those components in a container having a form factor shorter than the length of the fully assembled gun. Such methods can include providing at least one barrel 35 for firing projectiles; providing a breech block 20 containing a barrel housing 46; providing packaging for breech block 20 and the barrel or barrels 35 disengaged from the breech block 20 (and for any other desired components of the gun assembly. Such packaging preferably is shorter than the length of the fully assembled gun, thereby providing many benefits in shipping, handling, storage, retail display, and/or other uses and states of the gun. Such methods can include removing the barrel 35 from the barrel housing 46 of the breech block 20; and placing the barrel 35 and the breech block 20 in the packaging, including a plurality of interchangeable barrels within the package, selecting a desired barrel from such a plurality of interchangeable barrels, and/or assembling such a selected barrel with the remainder of the gun.

Other methods include modifying a gun that originally did not include interchangeable barrels to interchangeable barrel technology as described herein.

Those skilled in the art will understand that the specific order in which these steps occur is not limited by this description.

As indicated above, and as will be apparent to persons of ordinary skill in the art, the present invention provides a number of economical and environmental benefits. Among other things, because the barrel can be removed from the breech block, the two separate components can be packaged more compactly, and the size of the packaging used to carry them can therefore be reduced. Thus, in such embodiments, less packaging material is used, and a separate stock 10 is not required for "each" barrel, all of which in turn lowers the production costs and benefits the environment. Although such reduced packaging can be a benefit in certain applications, other embodiments can be packaged in a "full-sized" box and still provide other benefits of the invention.

Figure 12:
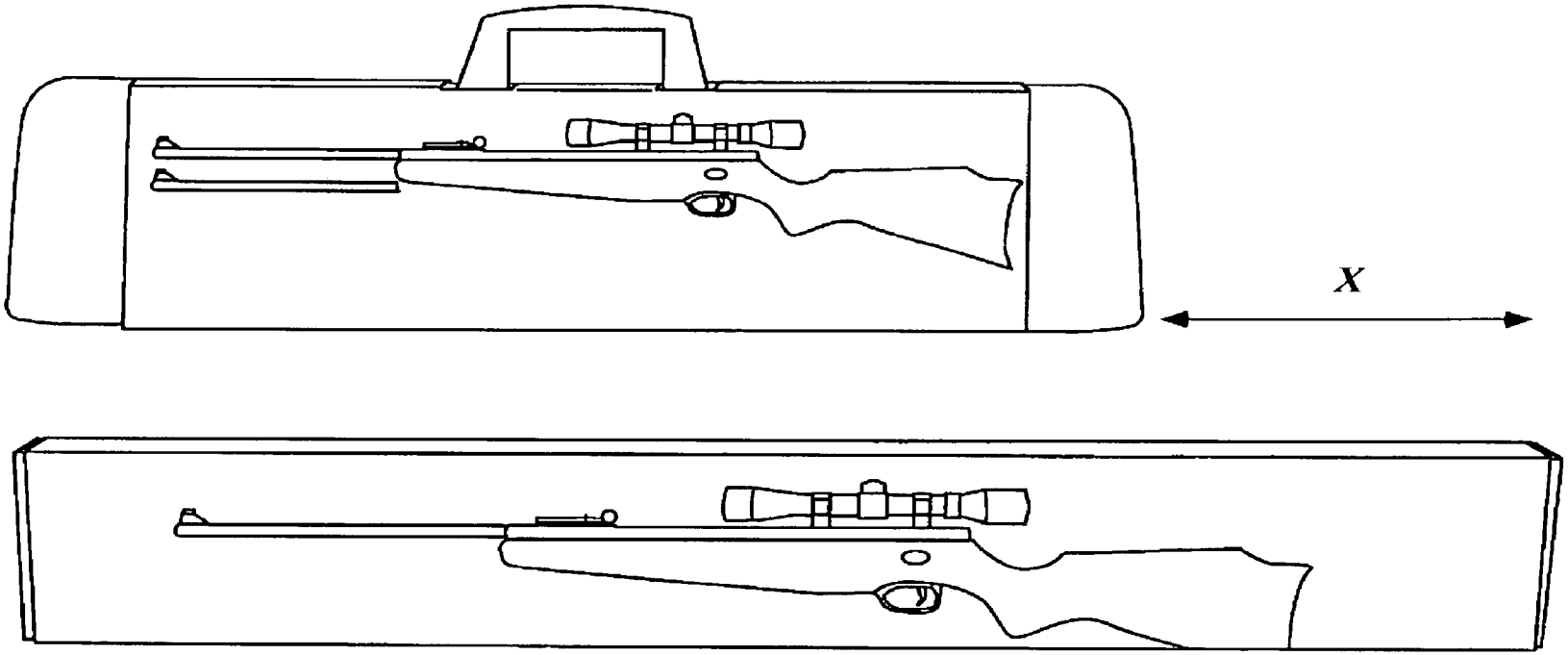
FIG. 12 illustrates the package size reduction or change that can be achieved with the invention, reducing the space required for shipping, storing, and displaying the gun.
Figure 13:
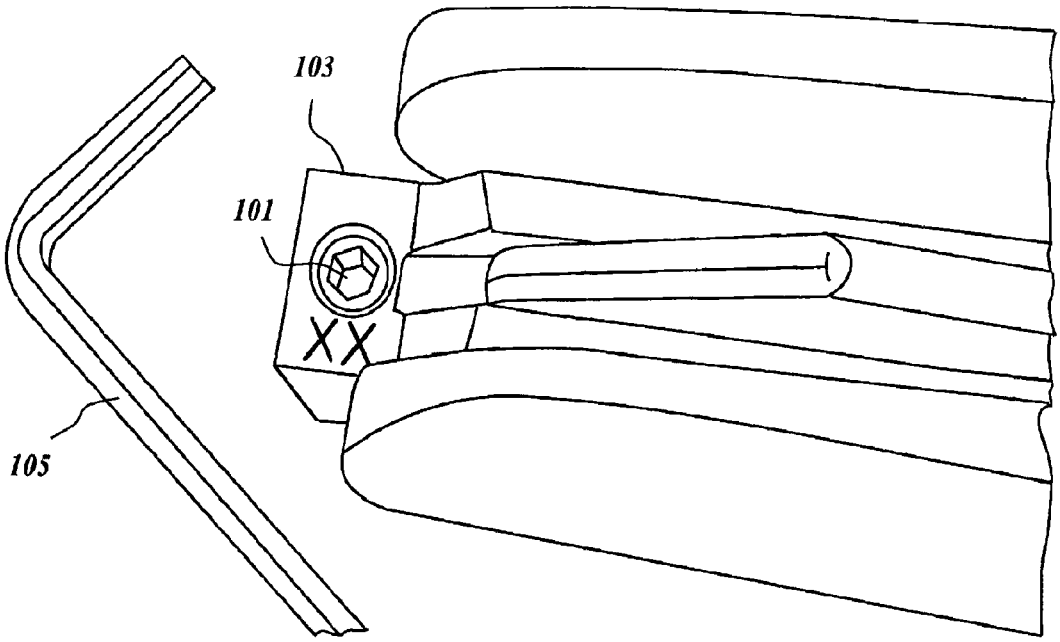
FIGS. 13-20 illustrate another of the many embodiments of the invention.

Furthermore, the expensive shelf space required to display the product at retail stores can be reduced by as much as one-third or more. A comparison of packaging for the same size gun is shown in FIG. 12, with the distance X indicating the reduction in length of the package provided by the invention (the longer package on the bottom has to be as long as the entire assembled gun). Therefore, the invention allows more packages to fit on retail shelves and displays, and can reduce the space required to warehouse, transport, and otherwise handle the guns, which can further increase profits for the store. Another benefit is that the reduced package size lowers shipping costs because products can be transported in greater density per shipment and/or with more flexibility in the space required, damage can be less likely to occur, etc.

Yet another feature of the present invention that provides numerous benefits is the set screw/clamping screw design which makes it quick and easy for consumers to change from one caliber to another. The clamping screw design provides quick and easy selection of two or more calibers within "one" rifle. Therefore, rather than buying two single caliber rifles, consumers only have to purchase one dual caliber rifle, which can be offered at a cost only slightly increased over the cost of a single rifle.

Other safety methods and features of the invention include storing the barrels in a completely separate location from the breech block, which is facilitated by the set screw/clamping screw design making it easy to remove the barrel.

As indicated above, for airguns or similar devices that use a "break barrel" design to cock the gun and prepare it to be fired (rather than using gunpowder, for example), the barrel typically is an integral part of the cocking/arming mechanism. A user typically grips the barrel and "folds" the gun to cock or arm it. In preferred embodiments of pump/break barrel guns, the invention permits removal and subsequent reattachment of the barrel (and the associated benefits of that removability), but also provides the necessary "cocking/arming" function.

Persons of ordinary skill in the art will understand that the benefits provided by the present invention are numerous and are not limited to the ones described herein. In addition, although the methods of the invention are described herein with steps occurring in a certain order, the specific order of the steps, or any continuation or interruption between steps, is not necessarily intended to be required for any given method of practicing the invention.

The apparatus and methods of the present invention have been described with some particularity, but the specific designs, constructions, and steps disclosed are not to be taken as delimiting of the invention. Modifications and further alternatives will make themselves apparent to those of ordinary skill in the art, all of which will not depart from the essence of the invention and all such changes and modifications are intended to be encompassed within the appended claims.

What is claimed is:

1. A break barrel gun, including:

a receiver portion having an air pressure generating mechanism to propel a projectile;

a breech section for removably receiving a barrel;

a barrel portion completely detachable from the remainder of the gun and configured to be removably inserted into the breech section;

a housing assembly portion of the breech section, configured to receive and retain the selected barrel in an operative relationship with the breech; and a sealing element providing a seal between said breech section and said barrel portion and said receiver portion when the breech section and receiver portion are engaged in a closed relationship, in which the housing assembly includes a screw element that can be tightened to help fix the barrel portion and breech section in a desired relationship with each other.

2. The gun of claim 1, further including a plurality of barrels each configured to be selectively inserted into the breech section.

3. The gun of claim 1 or claim 2, further including an indexing/alignment surface to facilitate desired alignment and positioning of the barrel portion and breech section.

4. The gun of claim 1 or claim 2, further including an indexing/alignment surface to facilitate desired alignment and positioning of the barrel portion and breech section, in which the indexing/alignment surface includes alignment arrows on the outside of the barrel portion and breech section.

5. The gun of claim 1 or claim 2, further including an indexing/alignment surface to facilitate desired alignment and positioning of the barrel portion and breech section, in which the indexing/alignment surface includes a notch in the exterior of the barrel portion through which a screw is placed, with the screw being held in an interfering fit with the barrel portion notch by engagement of the screw with the breech section.

6. The gun of claim 1 or claim 2, in which the housing assembly includes a domed indention on the outside of the barrel portion positioned and configured to receive a corresponding end of the screw element.

7. The gun of claim 1, wherein said sealing element is separate from said barrel portion.

8. In a break barrel gun, the combination comprising:

a stock portion, said stock portion including a receiver including an air pressure tube;

a barrel portion that is completely separable from the remainder of the gun including said stock portion;

a cocking element that is armed by folding the barrel and stock portions toward each other; and a sealing element between said receiver and said barrel portion for transmitting air pressure from said air pressure tube to said barrel portion.

9. The gun of claim 8, further including a plurality of barrel portions all configured to be selectively and removably attached to said stock portion.

10. The gun of claim 8 or claim 9, in which a breech portion is operably attached to the stock portion, the breech portion includes a chamber configured to receive the selected barrel, and a screw mechanism operably holds the barrel portion in a desired temporary assembly with the breech and stock portion.

* * * * *